United States Patent [19]

Nicolas

[11] Patent Number: 4,992,148

[45] Date of Patent: Feb. 12, 1991

[54] PROCESS FOR THE ELECTROLYTIC MANUFACTURE OF ALKALI METAL SULPHIDE

[75] Inventor: Edgard Nicolas, Rosignano, Italy

[73] Assignee: Solvay & Cie (Société Anonyme), Brussels, Belgium

[21] Appl. No.: 476,711

[22] Filed: Feb. 8, 1990

[30] Foreign Application Priority Data

Feb. 10, 1989 [IT] Italy ..... 19412 A/89

[51] Int. Cl.[5] ..... C25B 1/14

[52] U.S. Cl. ..... 204/92; 204/93; 204/128; 204/129; 204/290 F; 204/290 R; 204/291; 204/292; 204/293

[58] Field of Search ..... 204/92, 128, 129, 290 F, 204/290 R, 291, 292, 293, 93

[56] References Cited

U.S. PATENT DOCUMENTS

| | | | |
|---|---|---|---|
| 2,227,547 | 1/1941 | Lanzetti | 204/92 |
| 2,669,542 | 2/1954 | Doolsey | 204/93 |
| 3,864,226 | 2/1975 | Spitzer | 204/128 |
| 4,126,588 | 11/1978 | Ukihashi et al. | 204/296 |
| 4,248,680 | 2/1981 | Carlin et al. | 204/128 |
| 4,331,523 | 5/1982 | Kawasaki | 204/128 |

FOREIGN PATENT DOCUMENTS

| | | |
|---|---|---|
| 569192 | 5/1945 | United Kingdom . |
| 1402920 | 8/1975 | United Kingdom . |
| 1497748 | 1/1978 | United Kingdom . |
| 1497749 | 1/1978 | United Kingdom . |
| 1518387 | 7/1978 | United Kingdom . |
| 1522877 | 8/1978 | United Kingdom . |

OTHER PUBLICATIONS

Sconce, Chlorine, American Chemical Society, Monograph Series, 1962.

Shih et al, "Electrolytic Recovery of Sulfur and Hydrogen from Basic Sulfide Solution", 104:26189j, 1986.

*Primary Examiner*—T. Tung

*Assistant Examiner*—David G. Ryser

*Attorney, Agent, or Firm*—Spencer & Frank

[57] ABSTRACT

Process for the manufacture of alkali metal sulphide, in which an electrolysis cell is used in which a membrane which is selectively permeable to cations separates an anode chamber containing an anode from a cathode chamber containing a cathode, an electrolyte containing alkali metal is electrolyzed in the anode chamber and an aqueous solution of alkali metal polysulphide is electrolyzed simultaneously in the cathode chamber.

11 Claims, 1 Drawing Sheet

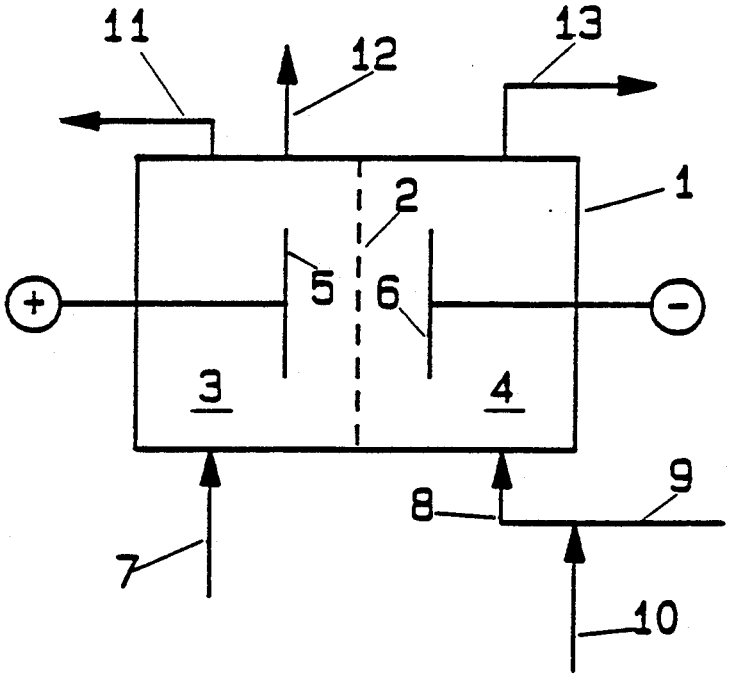
11
12
13
1
2
5
6
+
-
3
4
9
8
7
10

PROCESS FOR THE ELECTROLYTIC MANUFACTURE OF ALKALI METAL SULPHIDE

FIELD OF THE INVENTION

The present invention relates to a process for the manufacture of alkali metal sulphide.

TECHNOLOGY REVIEW

A known process for manufacturing sodium sulphide consists in reacting a solution of sodium polysulphide with a sodium amalgam obtained by electrolysis of an aqueous solution of sodium chloride in an electrolysis cell containing a mercury cathode (J. S. Sconce—Chlorine, Its Manufacture, Properties and Uses—Reinhold Publishing Corporation, 1962 page 180). This known process has the disadvantage of involving the use of a sodium amalgam, obtaining which by electrolysis is a burdensome operation which is further complicated by the need to avoid any contamination of the environment with mercury. It is difficult, furthermore, to avoid the presence of mercury in the sodium sulphide produced, and this constitutes another disadvantage of this known process.

The invention is aimed at providing a new process which avoids the abovementioned disadvantages.

SUMMARY OF THE INVENTION

The invention consequently relates to a process for the manufacture of alkali metal sulphide, according to which an electrolysis cell is used in which a membrane which is selectively permeable to cations separates an anode chamber containing an anode from a cathode chamber containing a cathode, an electrolyte containing cations of the said alkali metal is electrolysed in the anode chamber and an aqueous solution of alkali metal polysulphide is electrolysed simultaneously in the cathode chamber.

BRIEF DESCRIPTION OF THE DRAWING

The figure shows the diagram of a membrane electrolysis cell, in which a vessel (1) is divided by a membrane (2) into two chambers, namely an anode chamber (3) and a cathode chamber (4).

DETAILED DESCRIPTION OF THE INVENTION

The process according to the invention involves the use of an electrolysis cell of the type with a membrane which is selectively permeable to cations. It may be a membrane cell designed on the model of those suitable for the production of chlorine and of sodium hydroxide by electrolysis of aqueous solutions of sodium chloride.

The function of the membrane is to separate physically the electrolyte contained in the anode chamber from the polysulphide solution contained in the cathode chamber, while permitting only the transfer of cations from the anode chamber towards the cathode chamber. It must be made of a material which is inert towards the electrolyte used in the anode chamber and towards the alkali metal polysulphide solution. Membranes made of fluoropolymer containing functional groups derived from carboxylic, phosphonic or sulphonic acids can generally be employed. Preferred membranes are those made of perfluoropolymer containing functional groups derived from sulphonic and/or carboxylic acids. Examples of membranes of this type are those described in document Nos. GB-A-1,497,748 and GB-A-1,497,749

(Asahi Kasei Kogyo K.K.), GB-A-1,518,387, GB-A-1,522,877 and US-A-4,126,588 (Asahi Glass Company Ltd) and GB-A-1,402,920 (Diamond Shamrock Corp.). Examples of membranes which are adapted to the process according to the invention are those known under the trademarks Nafion (Du Pont de Nemours & Co) and Flemion (Asahi Glass Company Ltd).

The choice of the anode and cathode materials is determined by their need to withstand the electrolysis conditions mechanically and chemically. The cathode material, furthermore, must satisfy the condition of producing a reduction of sulphur during the electrolysis; it must therefore be chosen from those exhibiting a sulphur reduction potential which is more positive than that of hydrogen, under the conditions of the electrolysis. Examples of cathodes which can be employed in the process according to the invention are those in which the active material catalysing the electrolysis reaction is selected from molybdenum sulphide, copper sulphide, metals of group 8 of the Periodic Table of the elements and the alloys, sulphides and oxides of these metals. Nickel, cobalt, platinum, rhodium, ruthenium, osmium, iridium, oxides of these metals, molybdenum sulphide and copper sulphide are preferred.

The choice of the anode depends on the electrolyte used in the anode chamber of the electrolysis cell, in order to generate an electrochemical oxidation of the electrolyte in the normal conditions of electrolysis.

The electrolyte containing alkali metal cations is preferably an aqueous electrolyte. It is advantageously chosen from aqueous solutions of alkali metal hydroxide and aqueous solutions of the water-soluble salts of alkali metals. Salts which give rise to the emission of a gas at the anode during the electrolysis are preferred, such as chlorides, fluorides, carbonates, sulphates and phosphates, for example. If appropriate, the anode is chosen so as to obtain a release of an halogen or of oxygen in the normal conditions of electrolysis.

The aqueous solution of alkali metal polysulphide may be obtained by any suitable means. It is advantageously obtained by dissolving sulphur in an aqueous solution of alkali metal sulphide, according to the reaction:

$$M_2S + xS \rightarrow M_2S_{1+x}$$

in which M denotes the alkali metal.

In the process according to the invention, sulphur is reduced at the cathode and alkali metal cations move from the anode chamber into the cathode chamber by passing through the membrane, and the result of this is a progressive conversion of the alkali metal polysulphide to alkali metal sulphide.

At the end of the electrolysis an aqueous solution of alkali metal sulphide is collected from the cathode chamber. The alkali metal sulphide can then be extracted from the solution, for example by evaporating the latter.

The invention applies especially to the manufacture of sodium sulphide in the anhydrous or hydrated (generally nonahydrated) state.

Special features and details of the invention will emerge from the following description of a few embodiments of the process according to the invention, with reference to the single Figure of the attached drawing, which shows the diagram of a membrane electrolysis cell.

The electrolysis cell shown in the Figure comprises a vessel 1 which is divided, by a separator 2, into two chambers, anode chamber 3 and cathode chamber 4 respectively.

The separator 2 is a membrane with selective permeability for cations; it is, for example, a Nafion (Du Pont de Nemours & Co) membrane, which consists of a sheet of perfluoro polymer comprising functional groups derived from sulphonic acids.

The anode chamber 3 contains an anode 5 and the cathode chamber 4 contains a cathode 6. The anode 5 and the cathode 6 are coupled, respectively, to the positive terminal and to the negative terminal of a source of direct current, not shown.

In a first embodiment of the process according to the invention the anode chamber 3 is fed with an aqueous solution substantially saturated with sodium chloride 7; simultaneously, the cathode chamber 4 is fed with an aqueous solution of sodium polysulphide 8 obtained by dissolving sulphur 9 in an aqueous solution of sodium sulphide 10, upstream of the cell. During the electrolysis, chlorine is produced at the anode and sulphur is reduced at the cathode. Simultaneously, under the action of the electric field between the electrodes 5 and 6, sodium cations from the anode chamber 3 pass through the membrane 2 and enter the cathode chamber 4. The electrochemical process can therefore be summarized using the following reactions:

$$2Cl^- \longrightarrow Cl_2 + 2e$$

$$S + 2e \longrightarrow S^{--}$$

$$2Na^+(\text{anode}) \longrightarrow 2Na^+(\text{cathode})$$

$$2NaCl + S \longrightarrow Na_2S + Cl_2$$

Chlorine 11 and a dilute solution of sodium chloride 12 are collected from the anode chamber 3. Simultaneously, an aqueous solution 13 enriched with sodium sulphide is collected from the cathode chamber. The solution 13 may be treated to extract sodium sulphide therefrom, for example by a crystallization technique.

The embodiment just described thus permits the simultaneous manufacture of chlorine and of sodium sulphide.

In another embodiment of the invention, a concentrated aqueous solution of sodium hydroxide is substituted for the sodium chloride solution 7. Oxygen is produced at the anode during the electrolysis. The electrochemical process in the cell can therefore be summarized using the following reactions:

$$2\,OH^- \longrightarrow 1/2\,O_2 + H_2O + 2e$$

$$2e + S \longrightarrow S^{--}$$

$$2Na^+(\text{anode}) \longrightarrow 2Na^+(\text{cathode})$$

$$2NaOH + S \longrightarrow 1/2\,O_2 + H_2O + Na_2S$$

The following examples serve to illustrate the invention.

EXAMPLE 1

An electrolysis cell exhibiting the following characteristics was used:

anode: perforated titanium plate covered with a layer made up of an equimolar mixture of ruthenium oxide and of titanium dioxide;

cathode: expanded nickel sheet;

surface area useable for electrolysis: 14 $cm^2$;

separation between the anode and the cathode: 2 mm;

perfluoro membrane of sulphonic type, Nafion (Du Pont de Nemours & Co).

The anode chamber of the cell was fed with an aqueous solution containing 220 g of sodium chloride per kg, at a flow rate of 100 $cm^3$/hour.

370 $cm^3$ of an aqueous solution initially containing 4 moles of sodium sulphide and 1 mole of sulphur per liter were circulated in a loop into the cathode chamber at a velocity of 24 cm/s.

A potential difference of 3.22 V was applied to the terminals of the electrolysis cell. In addition, the cathode potential was kept at −1.1 V by means of a voltage-stabilizing circuit. The temperature in the cell was kept at 73° C.

At the end of the electrolysis, which lasted 4.4 hours, the sulphur content in the solution from the cathode chamber had fallen to approximately 0.15 moles/liter.

EXAMPLE 2

A cell similar to that of Example 1 was used, in which the anode consisted of an expanded nickel sheet, identical with the cathode.

The procedure followed was as in Example 1, under the following conditions:

electrolyte in the anode chamber: aqueous solution of sodium hydroxide (320 g/kg) at a flow rate of 70 $cm^3$/hour;

electrolyte in the cathode chamber: aqueous solution containing 4 moles of sodium sulphite and 1 mole of sulphur per liter;

potential difference at the cell terminals at the outset of the electrolysis: 3.01 V;

constant potential applied to the cathode: −0.91 V; temperature: 75° C.

At the end of the electrolysis, which lasted 10.8 hours, the sulphur content in the solution from the anode chamber had fallen to approximately 0.002 moles/liter.

EXAMPLE 3

The conditions of Example 2 were reproduced, this time by applying a constant current density equal to 4 kA per $m^2$ of anode area, throughout the electrolysis period. Furthermore, the cathode potential was no longer applied.

After 1.5 hours of electrolysis, hydrogen began to be released at the cathode and the electrolysis was then stopped. The residual sulphur content in the sodium sulphide solution collected from the cathode chamber was 0.7 moles/liter.

I claim:

1. A process for the manufacture of alkali metal sulphide comprising:

(a) preparing an electrolysis cell in which a membrane which is selectively permeable to cations separates an anode chamber containing an anode from a cathode chamber containing a cathode by placing an electrolyte containing alkali metal ions in said anode chamber and an aqueous solution of alkali metal polysulfide in said cathode chamber;

(b) electrolysing said electrolyte containing alkali metal in said anode chamber; and (c) simultaneously electrolysing said aqueous solution of alkali metal polysulphide in said cathode chamber to produce an alkali metal sulfide.

2. The process according to claim 1, further comprising preparing said alkali metal polysulphide solution by dissolving sulphur in an aqueous solution of alkali metal sulphide.

3. The process according to claim 1, wherein said electrolyte containing alkali metal ions is an aqueous solution of alkali metal chloride or an aqueous solution of alkali metal hydroxide.

4. The process according to claim 1, wherein said membrane comprises a perfluoropolymer containing functional groups derived from sulphonic acid.

5. The process according to claim 1, wherein said membrane comprises a perfluoropolymer containing functional groups derived from carboxylic acid.

6. The process according to claim 1, wherein said membrane comprises a perfluoropolymer containing functional groups derived from sulphonic acid and carboxylic acid.

7. The process according to claim 1, wherein said cathode comprises an active material selected from the group consisting of molybdenum sulphide, copper sulphide, metals of group 8 of the Periodic Table of the elements, alloys of the metals of group 8 of the Periodic Table of the elements, sulphides of the metals of group 8 of the Periodic Table of the elements, and oxides of the metals of group 8 of the Periodic Table of the elements.

8. The process according to claim 7, wherein the active material of said cathode is selected from the group consisting of nickel, cobalt, platinum, rhodium, ruthenium, osmium, iridium and the oxides of platinum, rhodium, ruthenium, osmium and iridium.

9. The process according to claim 8, wherein said cathode comprises a substrate comprising titanium and a coating comprising oxide of a metal selected from the group consisting of platinum, rhodium, ruthenium, osmium and iridium.

10. The process according to claim 7, wherein said cathode comprises a substrate made of nickel and a coating, wherein said coating is molybdenium sulphide or copper sulphide.

11. The process according to claim 1, wherein said alkali metal sulphide is sodium sulphide.

* * * * *